US007546792B2

(12) United States Patent
Liu et al.

(10) Patent No.: US 7,546,792 B2
(45) Date of Patent: Jun. 16, 2009

(54) QUICK RELEASE STRUCTURE AND SAW BLADE GUARD ASSEMBLY OF TABLE SAW USING SAME

(75) Inventors: Chia-Sheng Liu, Chiayi County (TW); Yu-Feng Chan, Kaohsiung County (TW)

(73) Assignee: Durq Machinery Corp., Taichung (TW)

( * ) Notice: Subject to any disclaimer, the term of this patent is extended or adjusted under 35 U.S.C. 154(b) by 210 days.

(21) Appl. No.: 11/723,814

(22) Filed: Mar. 22, 2007

(65) Prior Publication Data

US 2008/0121080 A1 May 29, 2008

(30) Foreign Application Priority Data

Nov. 29, 2006 (TW) ..... 95144266 A

(51) Int. Cl.
*B27G 19/00* (2006.01)

(52) U.S. Cl. ..... 83/478; 83/102.1; 83/477.2

(58) Field of Classification Search ..... 83/102.1, 83/477.2, 478; 403/348, 353; 411/349, 549, 411/553; 24/458
See application file for complete search history.

(56) References Cited

U.S. PATENT DOCUMENTS

| | | | | |
|---|---|---|---|---|
| 7,210,386 | B1 * | 5/2007 | Chang | 83/102.1 |
| 7,302,878 | B2 * | 12/2007 | Chang | 83/102.1 |
| 7,437,981 | B2 * | 10/2008 | Burke et al. | 83/102.1 |
| 2003/0156919 | A1 * | 8/2003 | Schwarz et al. | 411/349 |
| 2006/0042441 | A1 * | 3/2006 | Ichikawa et al. | 83/102.1 |
| 2007/0056416 | A1 * | 3/2007 | Shibata | 83/440.2 |

* cited by examiner

*Primary Examiner*—Stephen Choi
(74) *Attorney, Agent, or Firm*—Browdy and Neimark, P.L.L.C.

(57) ABSTRACT

A quick release structure for use in the saw blade guard assembly of a table saw is disclosed to include a mounting member affixed to the base of the table saw, a coupling block detachably attached to the mounting member to hold a pivoted attachment member, for example, a saw blade guard, and a rotary locking member mounted in the coupling block and rotatable relative the coupling block between two positions to lock the coupling block to the mounting member or to release the coupling block.

12 Claims, 13 Drawing Sheets

QUICK RELEASE STRUCTURE AND SAW BLADE GUARD ASSEMBLY OF TABLE SAW USING SAME

BACKGROUND OF THE INVENTION

1. Field of the Invention

The present invention relates generally to a table saw and more particularly, to the saw blade guard assembly of a table saw that uses a quick release structure.

2. Description of the Related Art

FIG. 1 shows a saw blade guard assembly 1 for table saw according to the prior art. According to this design, the saw blade guard assembly 1 comprises a riving knife 2, a guard 3, two detents 4, and a spring member 5. The riving knife 2 is affixed to the base of the table saw and kept apart from the saw blade (not shown) at a distance to avoid jamming of already cut and separated parts of the workpiece, for example wood, during cutting. The riving knife 2 has two pivot holes 2*a* and 2*b* and an axle hole 2*c* at the top. The guard 3 is pivotally connected to the pivot hole 2*a* at the rear end of the riving knife 2 with a pin 3*a*. The two detents 4 are pivotally bilaterally connected to the pivot hole 2*b* at the front end of the riving knife 2 with a pin 4*a* and two rings 4*b*. The detents 4 are to prohibit jumping of the cut part during cutting. The spring member 5 is mounted on the rings 4*b*, having two opposite ends respectively hooked on the two detents 4 to impart a forward biasing force to the detents 4, causing the detents 4 to rest the respective front ends on the pin 4*c* that is inserted through the axle hole 2*c* so that the detents 4 are kept pressed on the surface of the workpiece to prohibit jumping of the cut part during cutting.

The aforesaid structure provides a protection for safety operation of the table saw. However, because the guard 3 and the detents 4 are fastened to the riving knife 2 with pins 3*a* and 4*a*, it is complicated to dismount the parts for package to save the packing dimensions during delivery of the machine. Further, dismounting the guard 3 and the detents 4 requires a special tool. After dismounting, the detached parts (such as the pins) must be well received to prevent the parts from missing. It is also complicated to assemble the parts again.

SUMMARY OF THE INVENTION

The present invention has been accomplished under the circumstances in view. It is therefore one objective of the present invention to provide a quick release structure, which allows quick mounting and dismounting of the parts equipped with the quick release structure, thereby saving much mounting and dismounting time.

It is another objective of the present invention to provide a saw blade guard assembly for table saw, which uses the aforesaid quick release structure so that the saw blade guard assembly can quickly be removed from the table saw or installed in the table saw without using tools.

To achieve the aforesaid objectives, the quick release structure comprises a mounting member having a body with a retaining hole, a coupling block having a clamping groove for fastening to the body of the mounting member and a through hole in communication with the clamping groove, and a rotary locking member having a rod body pivotally inserted in the through hole of the coupling block and provided with a retaining portion at an end thereof engaging the retaining hole of the mounting member, and a pushable portion at the other end thereof turnable by an external force to move the retaining portion to be disengaged from the retaining hole of the mounting member.

Further, the saw blade guard assembly in accordance with the present invention has an attachment member using the quick release structure so that the attachment member can quickly be installed in the table saw or dismounted from the table saw.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
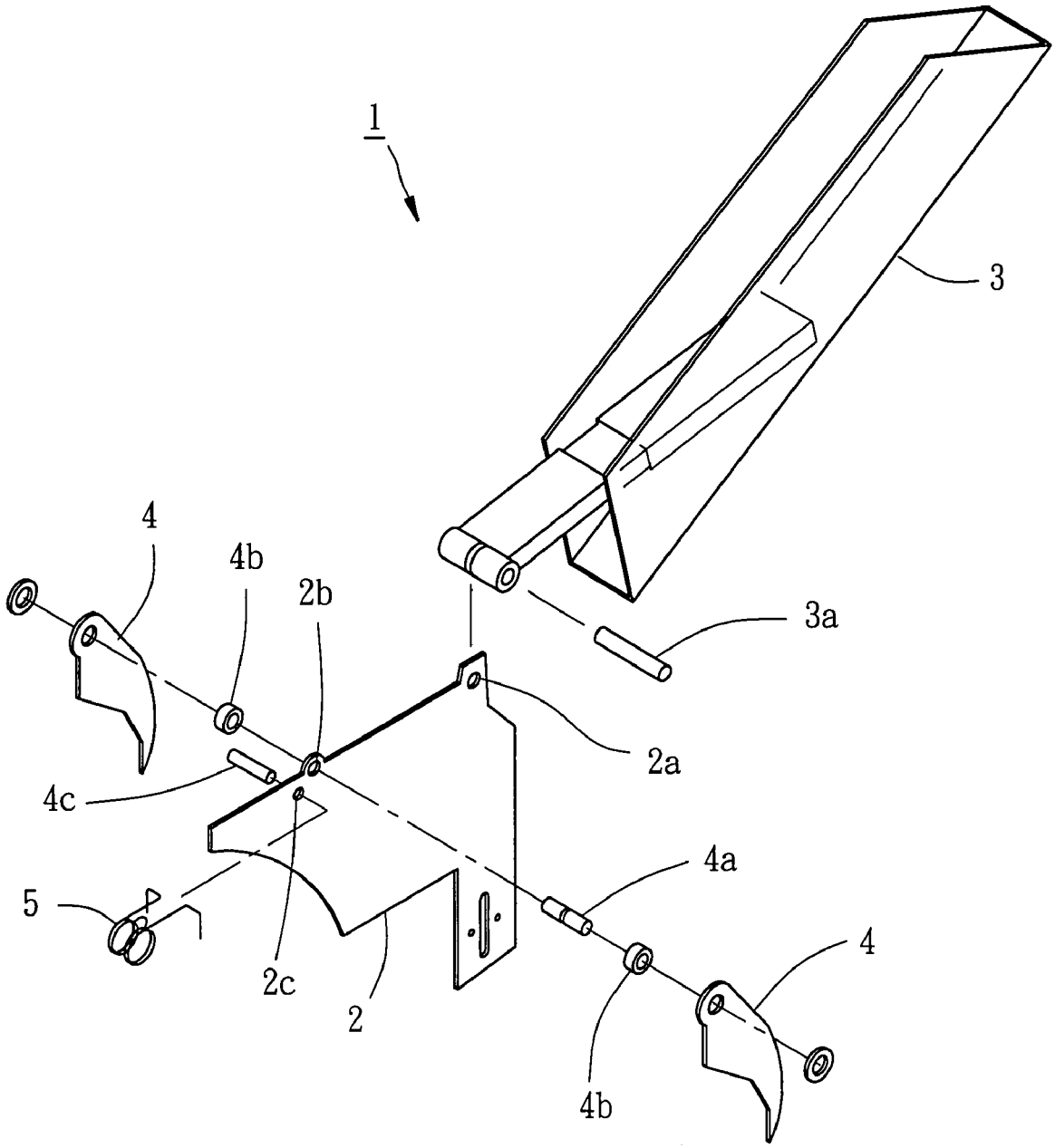
FIG. 1 PRIOR ART
FIG. 1 is an exploded view of a saw blade guard assembly for table saw according to the prior art.
Figure 2:
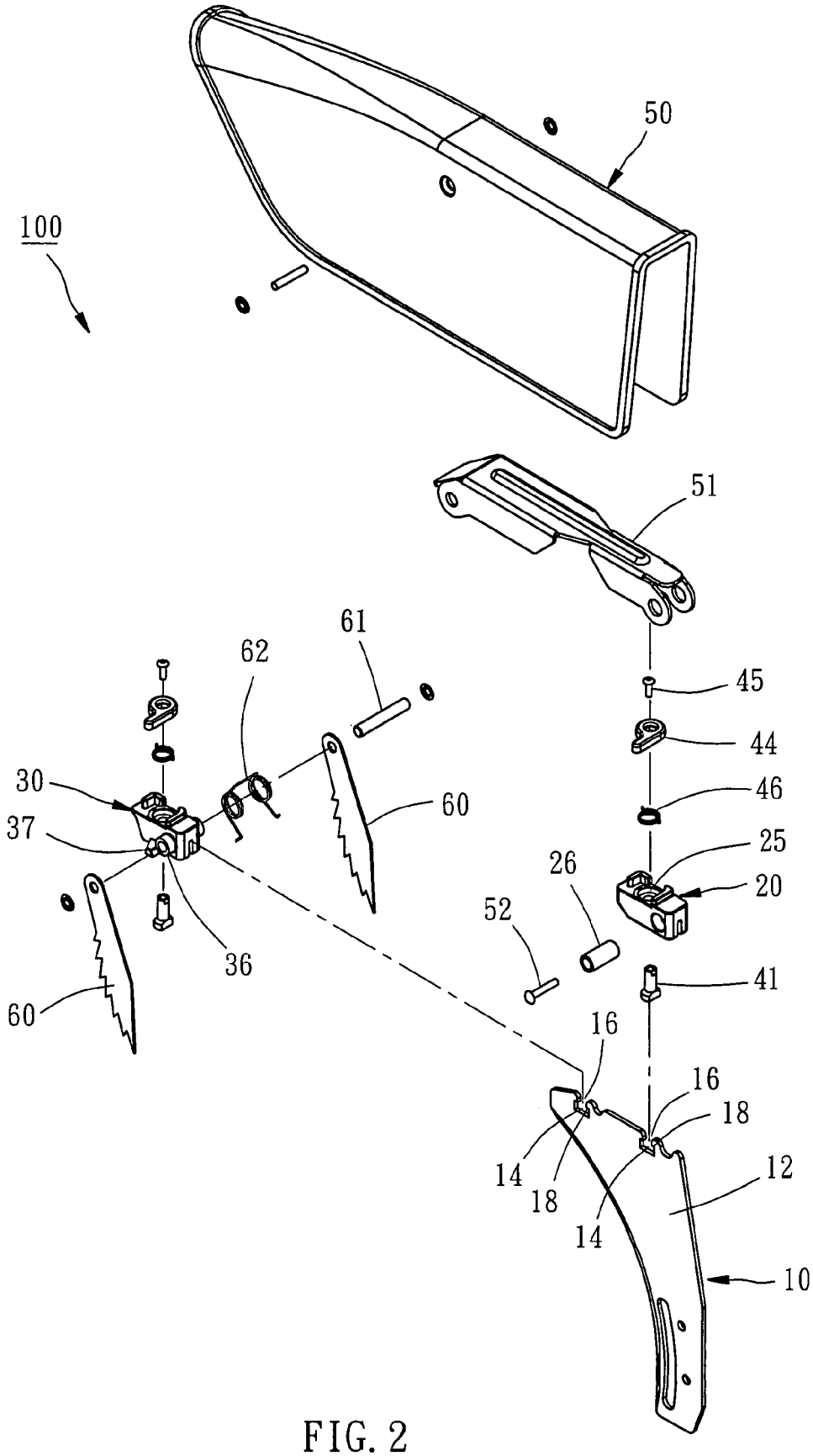
FIG. 2 is an exploded view of a saw blade guard assembly for table saw according to a first embodiment of the present invention.
Figure 3:
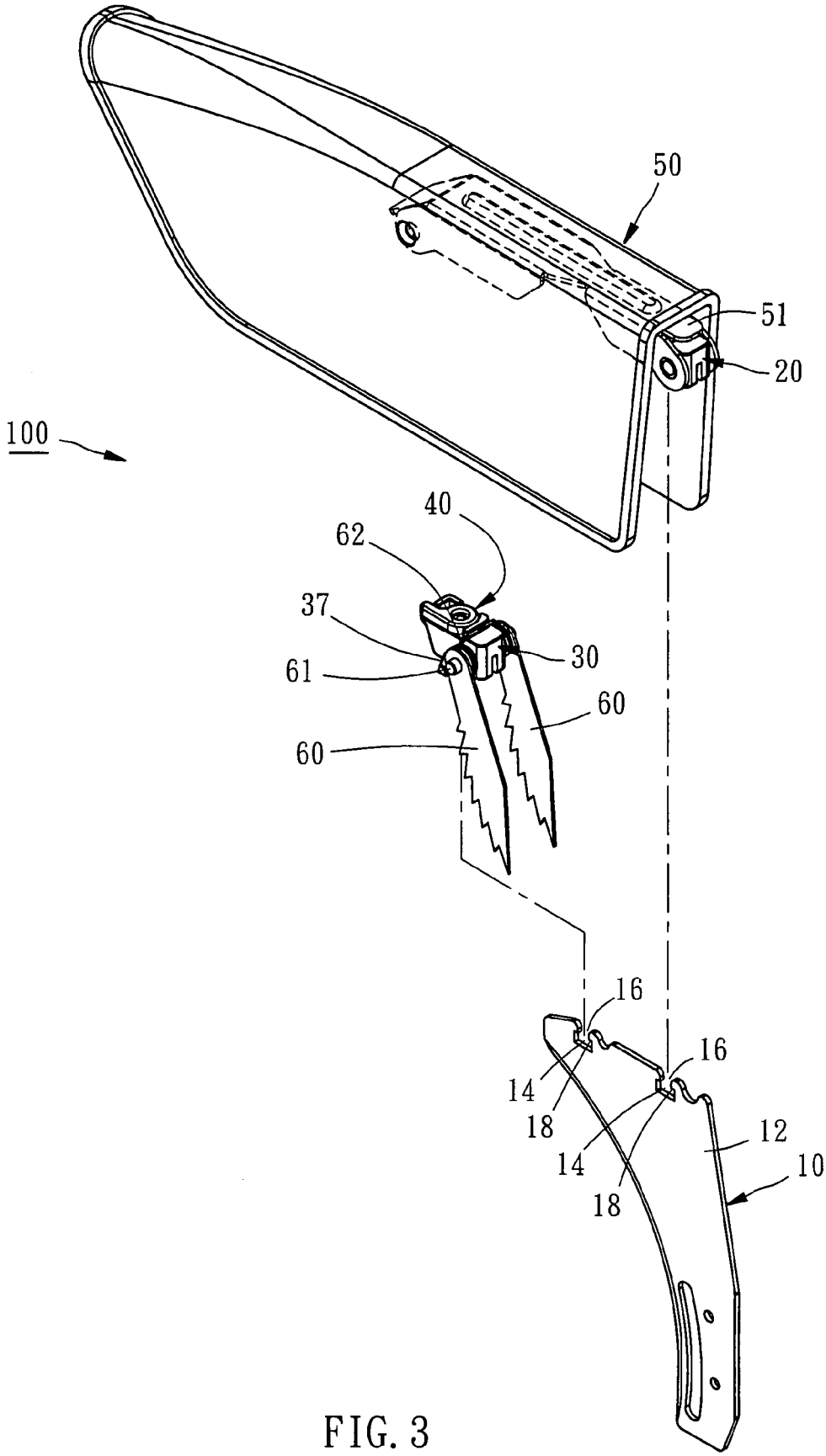
FIG. 3 is similar to FIG. 2 but showing some parts of the saw blade guard assembly are assembled.
Figure 4:
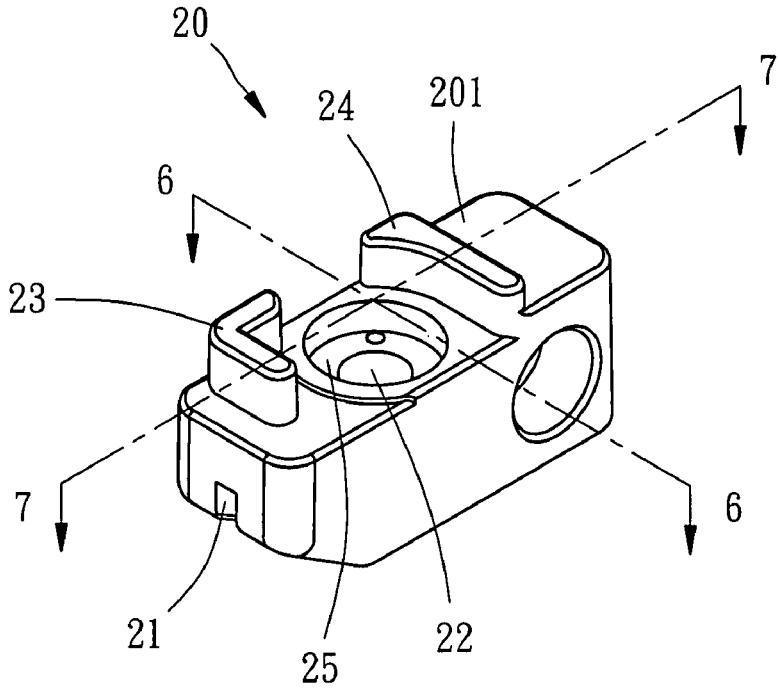
FIG. 4 is a perspective view of the first coupling block according to the first embodiment of the present invention.
Figure 5:
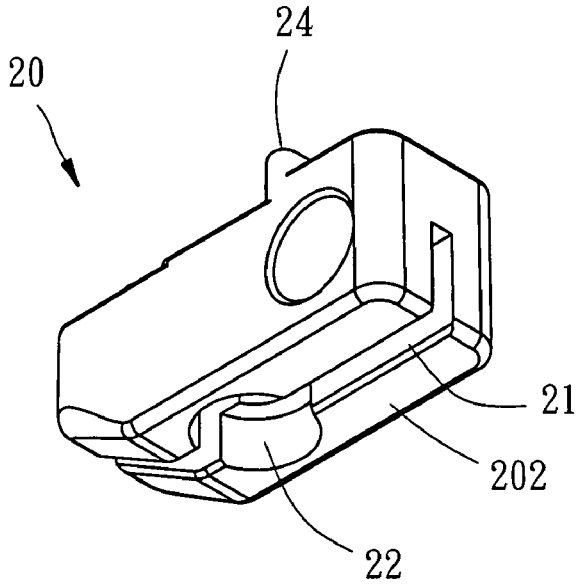
FIG. 5 corresponds to FIG. 4 when viewed from another direction.
Figure 6:
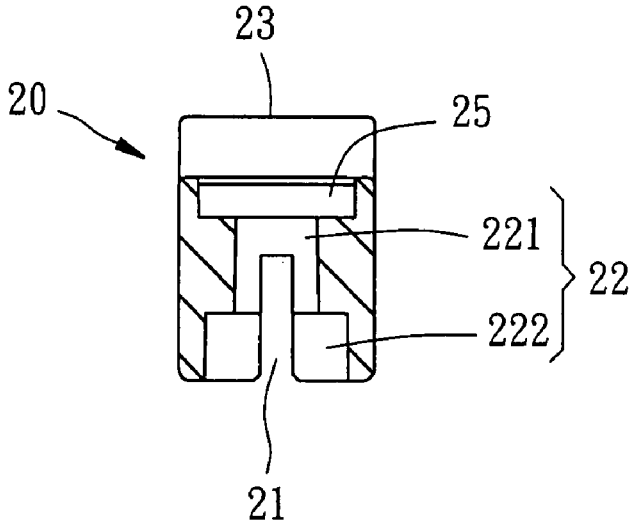
FIG. 6 is a sectional view taken along line 6-6 of FIG. 4.
Figure 7:
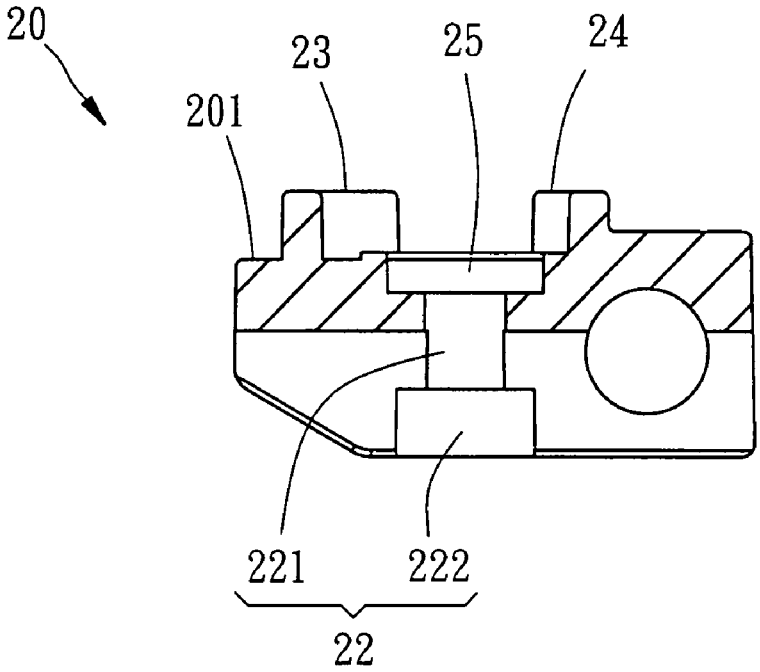
FIG. 7 is a sectional view taken along line 7-7 of FIG. 4.

As shown in FIGS. 2-17, a saw blade guard assembly 100 in accordance with a first embodiment of the present invention comprises a mounting member 10, a first coupling block 20, a second coupling block 30, two rotary locking members 40, a return member 46, a guard 50, two detents 60, and a biasing member 62. The mounting member 10, the coupling blocks 20 and 30, the rotary locking members 40 and the return member 46 constitute a quick release structure.

The mounting member 10 has a body 12. The body 12 is inserted with its bottom end into the inside of the base of the table saw (not shown), having two retaining holes 14 near the top, two top notches 16 respectively formed on the topmost edge above and in communication with the retaining holes 14, and two hook portions 18 respectively suspending in between the retaining holes 14 and the top notches 16.

The first coupling block 20 has a top surface 201, a bottom surface 202, a clamping groove 21 formed on the bottom surface 202 for securing the body 12 of the mounting member 10, a through hole 22 cut through the top surface 201 and the bottom surface 202 in communication with the clamping groove 21, a first stop block 23 and a second stop block 24 upwardly protruding from the top surface 201 and defining a first stop portion and a second stop portion respectively, and a countersunk groove 25 formed on the top surface 201 in communication with the through hole 22. The through hole 22 is a stepped hole having an upper section 221 of relatively smaller diameter and a lower section 222 of relatively greater diameter. Further, an axle sleeve 26 is transversely fastened to the first coupling block 20 near its rear end (see FIG. 2) to work as a mounting portion of the first coupling block 20. A pivot pin 52 is fastened to the axle sleeve 26 to pivotally connect one end of a link 51 to the first coupling block 20. The other end of the link 51 is pivotally connected to an attachment member, i.e. the guard 50.

Figure 8:
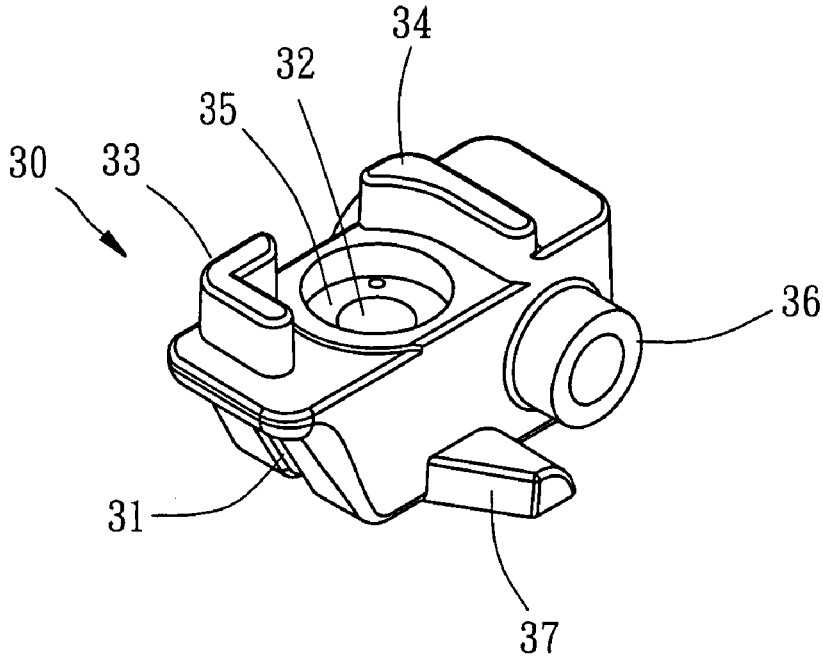
FIG. 8 is a perspective view of the second coupling block according to the first embodiment of the present invention.
Figure 9:
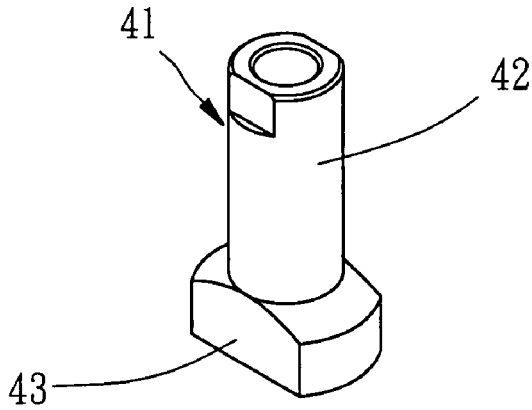
FIG. 9 is a perspective view of the retaining rod according to the first embodiment of the present invention.

The second coupling block 30 is substantially similar to the first coupling block 20. As shown in FIG. 8, the second coupling block 30 has a clamping groove 31, a through hole 32, a first stop block 33, a second stop block 34, a countersunk groove 35, and an axle sleeve 36. The second coupling block 30 further has two protruding rods 37 respectively extended from two opposite lateral sides.

The two rotary locking members 40 are identical and respectively inserted through the through hole 22 of the first coupling block 20 and the through hole 32 of the second coupling block 30, each including a retaining rod 41 and a lug 44. The arrangement between one rotary locking member 40 and the first coupling block 20 is explained hereinafter. Because the arrangement between the other rotary locking member 40 and the second coupling block 20 is similar to the arrangement between one rotary locking member 40 and the first coupling block 20, no further detailed description in this regard is necessary.

The retaining rod 41 has a rod body 42, which has an outer diameter approximately equal to the upper section 221 of the through hole 22 of the first coupling block 20 and is inserted into the upper section 221 of the through hole 22 of the first coupling block 20, and a protrusion head 43 disposed at the bottom end of the rod body 42 and suspending in the lower section 222 of the through hole 22 of the first coupling block 20. The protrusion head 43 works as the retaining portion of the rotary locking member 40.

Figure 10:
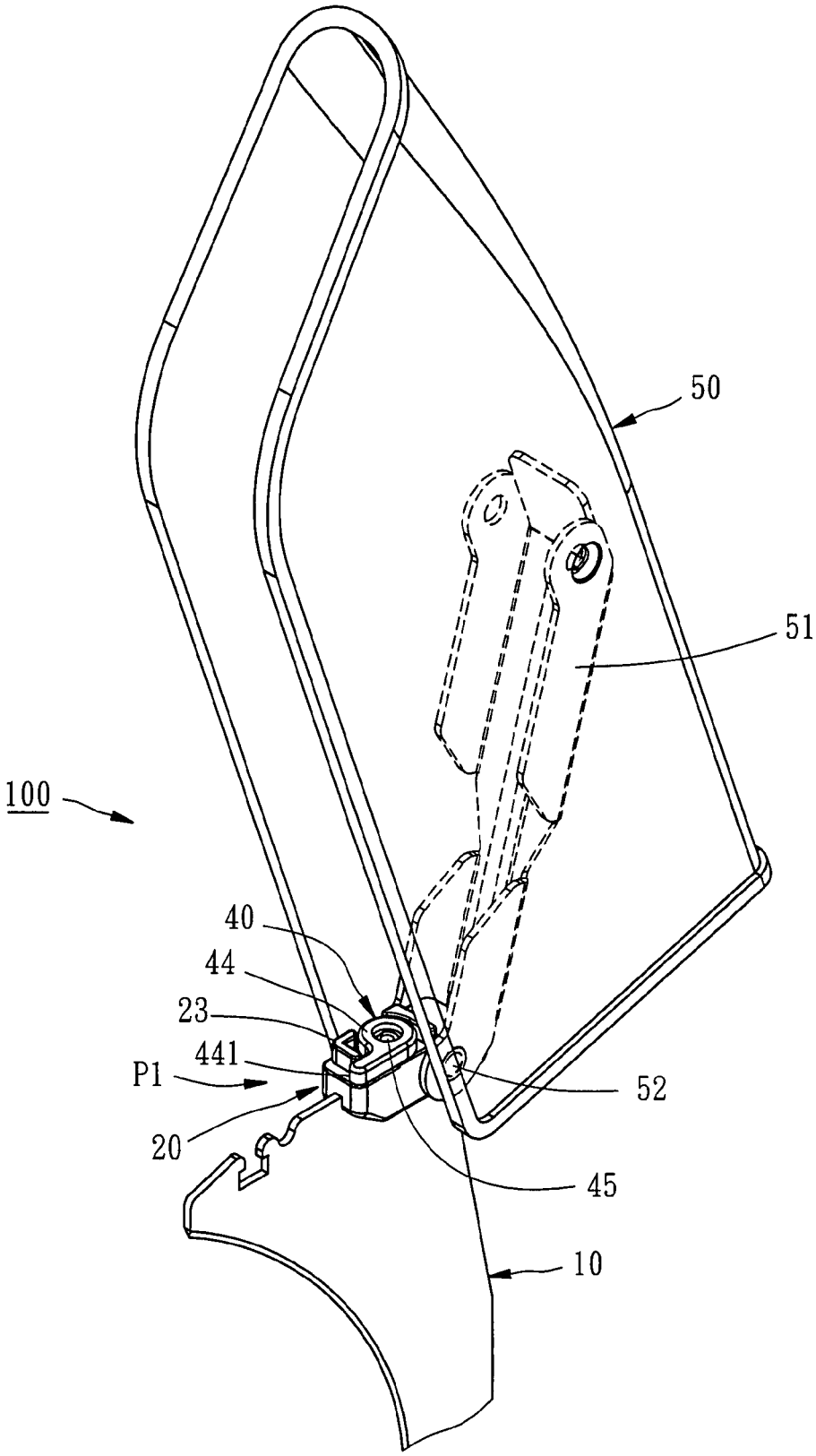
FIG. 10 is a perspective view of the first embodiment of the present invention, showing that the lug is held in the first position and the first coupling block is locked to the mounting member.
Figure 12:
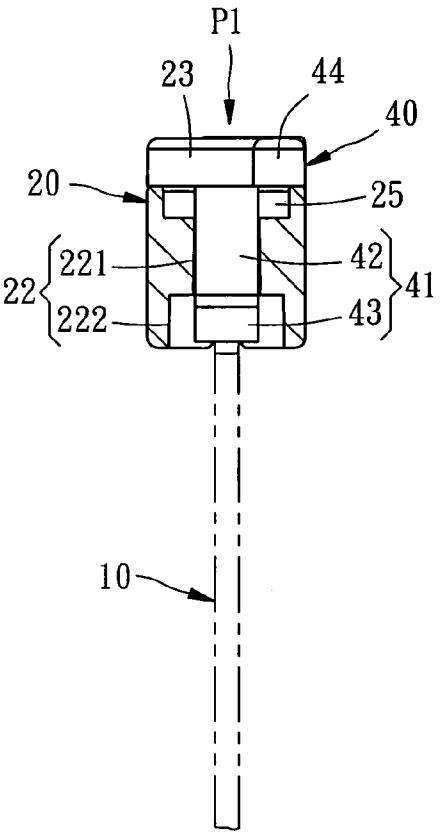
FIG. 12 is a front view of FIG. 11.
Figure 11:
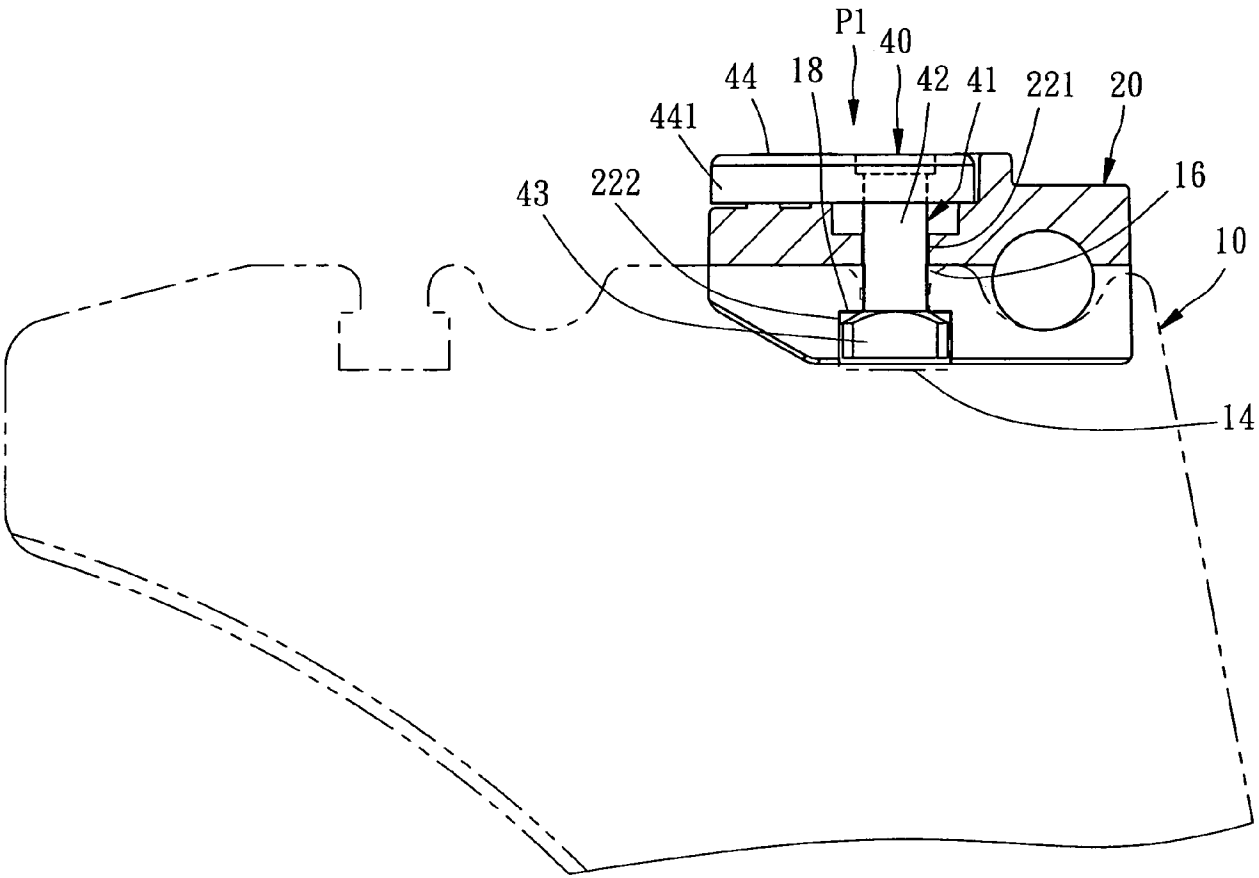
FIG. 11 is a sectional view in an enlarged scale of a part of FIG. 10, showing the positioning of the rotary locking member in the first coupling block.
Figure 13:
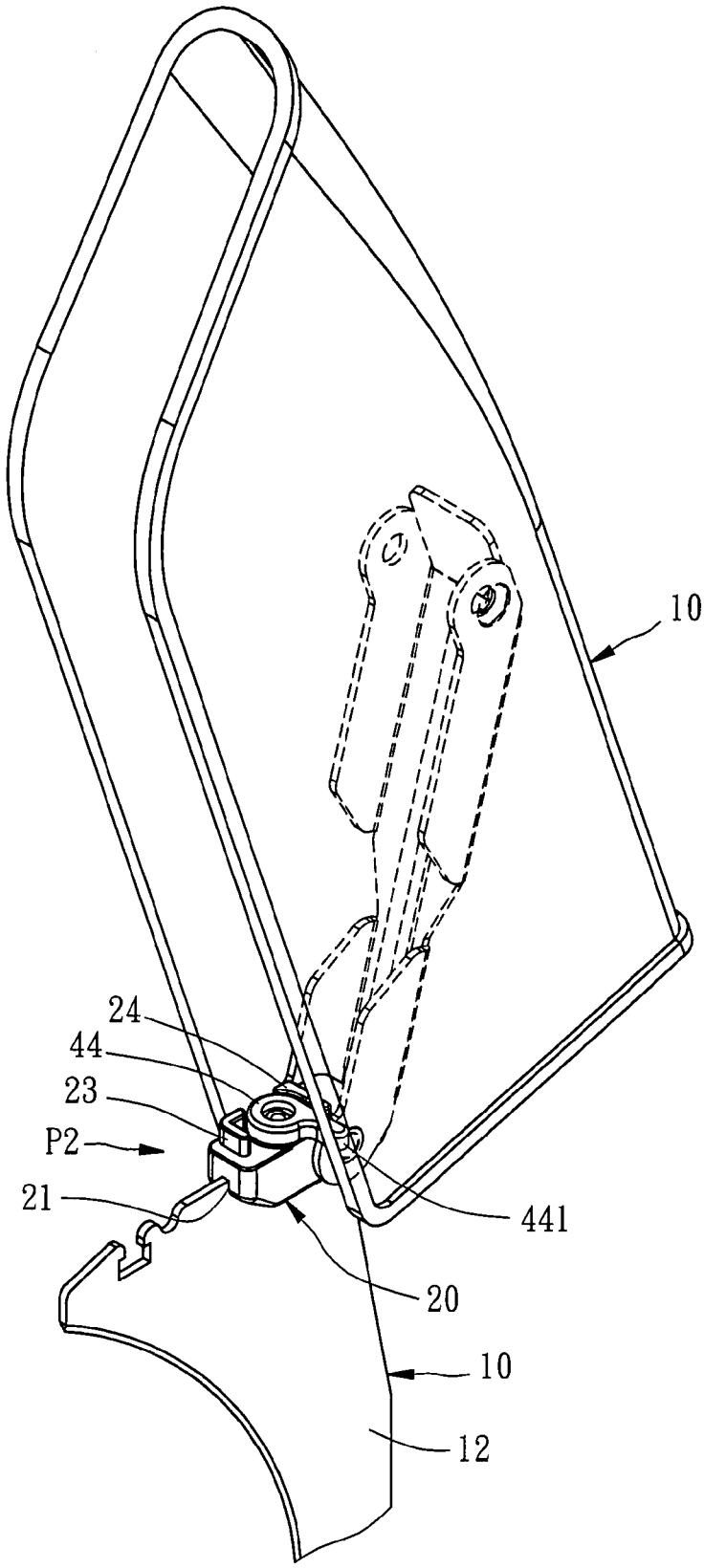
FIG. 13 is similar to FIG. 10 but showing that the lug is turned to the second position and the first coupling block is released from the mounting member.
Figure 15:
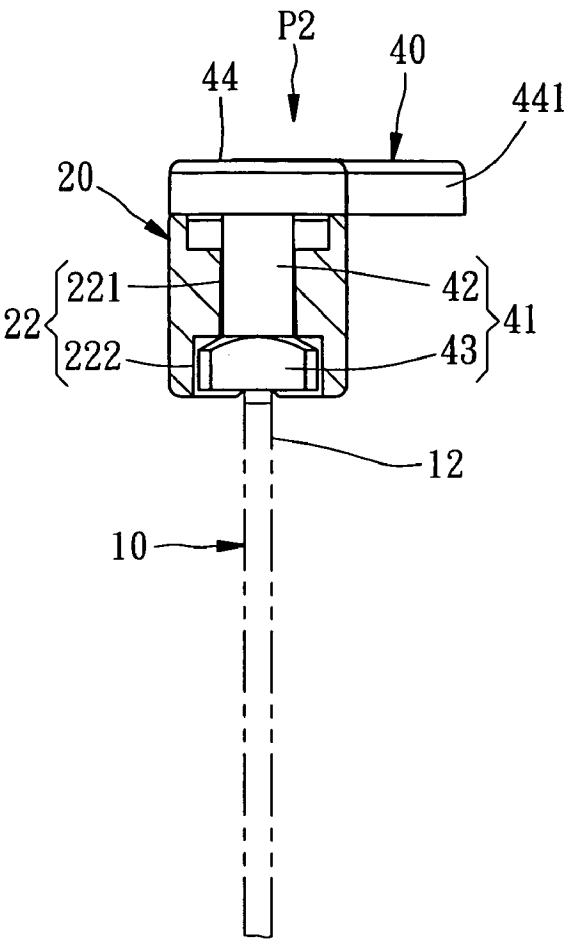
FIG. 15 is a front view of FIG. 14.
Figure 14:
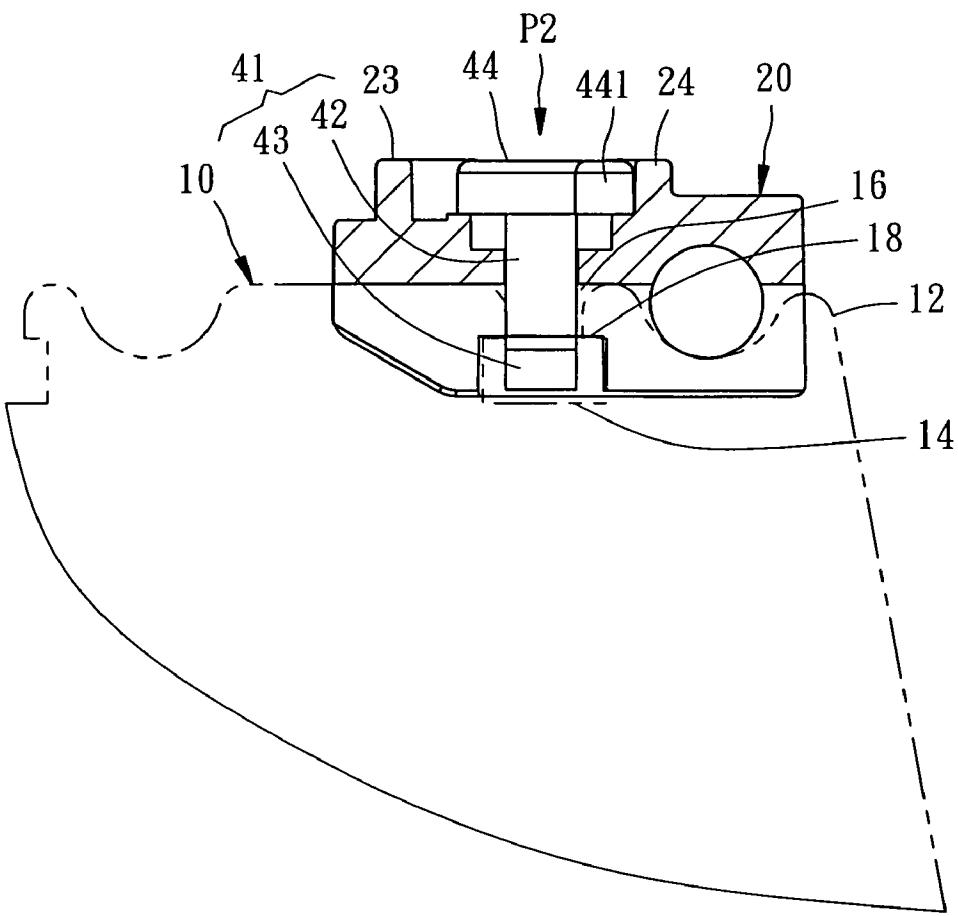
FIG. 14 is a sectional view in an enlarged scale of a part of FIG. 13, showing the positioning of the rotary locking member in the first coupling block.

The lug 44 works as the pushable portion of the rotary locking member 40. The lug 44 is affixed to the rod body 42 of the retaining rod 41 with a pin 45, having a rod 441 for turning by the user. The return member 46 according to this embodiment is a torsion spring mounted in the countersunk groove 25 of the first coupling block 20 and adapted to impart a return force to the lug 44 each time the lug 44 is biased by an external force. When the lug 44 receives no external pressure, the rod 441 is stopped at the first stop block 23 in a first position P1, as shown in FIGS. 10-12. At this time, the protrusion head 43 is engaged with one hook portion 18 of the mounting member 10 (see FIG. 11), thus the first coupling block 20 is not detachable from the mounting member 10. On the contrary, when giving a pressure to the rod 441 against the aforesaid return force, the lug 44 is moved from the first position P1, as shown in FIG. 10, to a second position P2 and stopped at the second stop block 24, as shown in FIGS. 13-15. At this time, the protrusion head 43 is disposed in a crossed manner relative to the body 12 of the mounting member 10 (see FIG. 15) and disengaged from the corresponding hook portion 18 of the mounting member 10 (see FIG. 14), allowing removal of the first coupling block 20 with the guard 50 from the mounting member 10. Therefore, the invention allows quick dismounting of the guard from the table saw.

The two detents 60 are respectively pivotally connected to the two opposite ends of the axle sleeve 36 in the second coupling block 30 by a pin 61. The biasing member 62 is mounted on the axle sleeve 36 and stopped against the detents 60 to force the detents 60 against the protruding rods 37 respectively.

Figure 17:
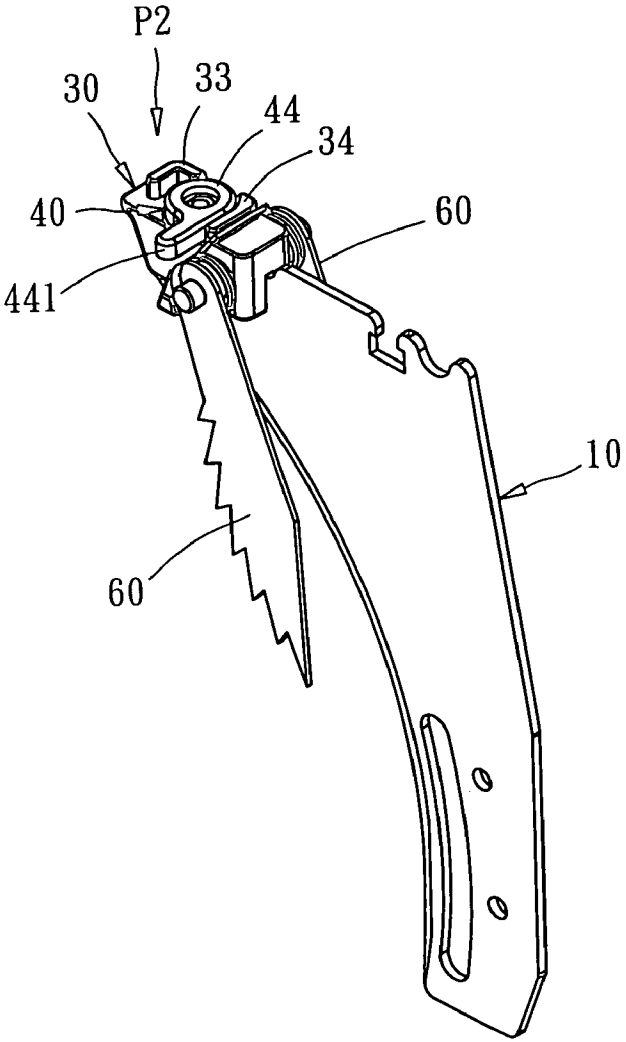
FIG. 17 is similar to FIG. 16 but showing that the lug is turned to the second position and the second coupling block is released from the mounting member.
Figure 16:
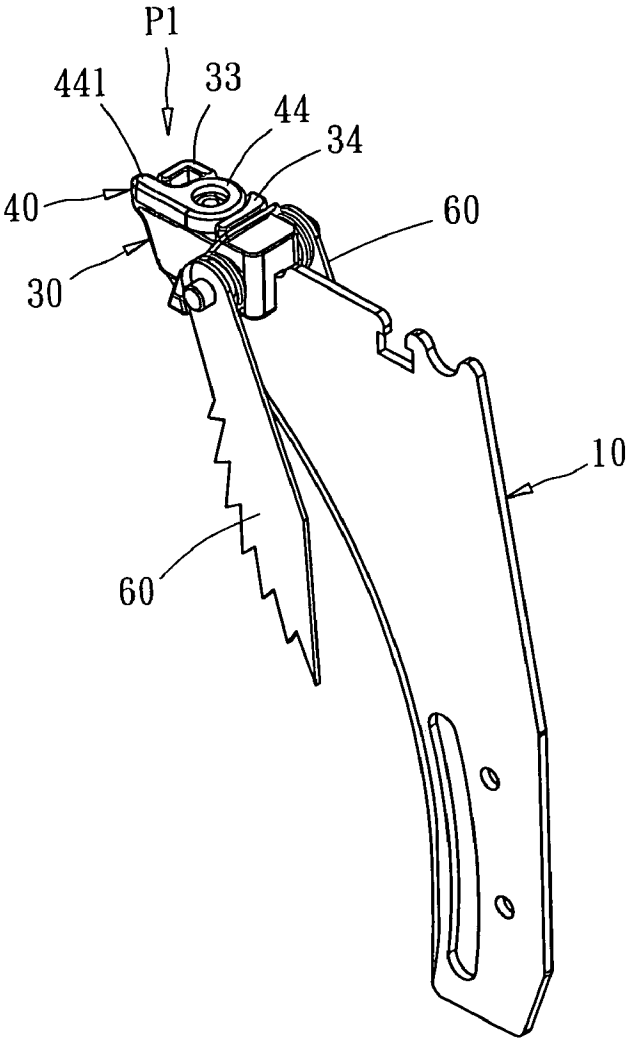
FIG. 16 is a perspective view of a part of the first embodiment of the present invention, showing that the lug is held in the first position and the second coupling block is locked to the mounting member.

As shown in FIGS. 16 and 17, the method of dismounting the detents 60 is similar to the way of dismounting the guard 50, i.e., operate the rod 441 of the associating rotary locking member 40 to turn the associating lug 44 from the first position P1 to the second position P2. During rotation of the lug 44, the head 43 is moved from the position shown in FIG. 11 to the position shown in FIG. 14 where the protrusion head 43 is disengaged from the corresponding hook portion 18 of the mounting member 10, allowing removal of the second coupling block 30 with the two detents 60 from the mounting member 10.

On the contrary, when wanting to install the guard 50 or the detents 60 in the mounting member 10, for example, when wanting to install the guard 50 in the mounting member 10, operate the rod 441 to hold the lug 44 in the second position P2, and then move the first coupling block 20 toward the body 12 of the mounting member 10. When moving the first coupling block 20 toward the body 12 of the mounting member 10, the protrusion head 43 is intersected with the body 12 at right angles (see FIGS. 14 and 15), and therefore the protrusion head 43 of the associating rotary locking member 40 is moved through the associating top notch 15 into the associating retaining hole 13. When the protrusion head 43 is inserted into the associating retaining hole 13, release the rod 441 for enabling the return member 46 to return the lug 44 from the second position P1 to the first position P1. When the lug 44 reaches the first position P1, the protrusion head 43 is forced into engagement with the associating hook portion 18 of the mounting member 10 again (see FIG. 1), thereby finishing the installation of the guard 50.

Figure 18:
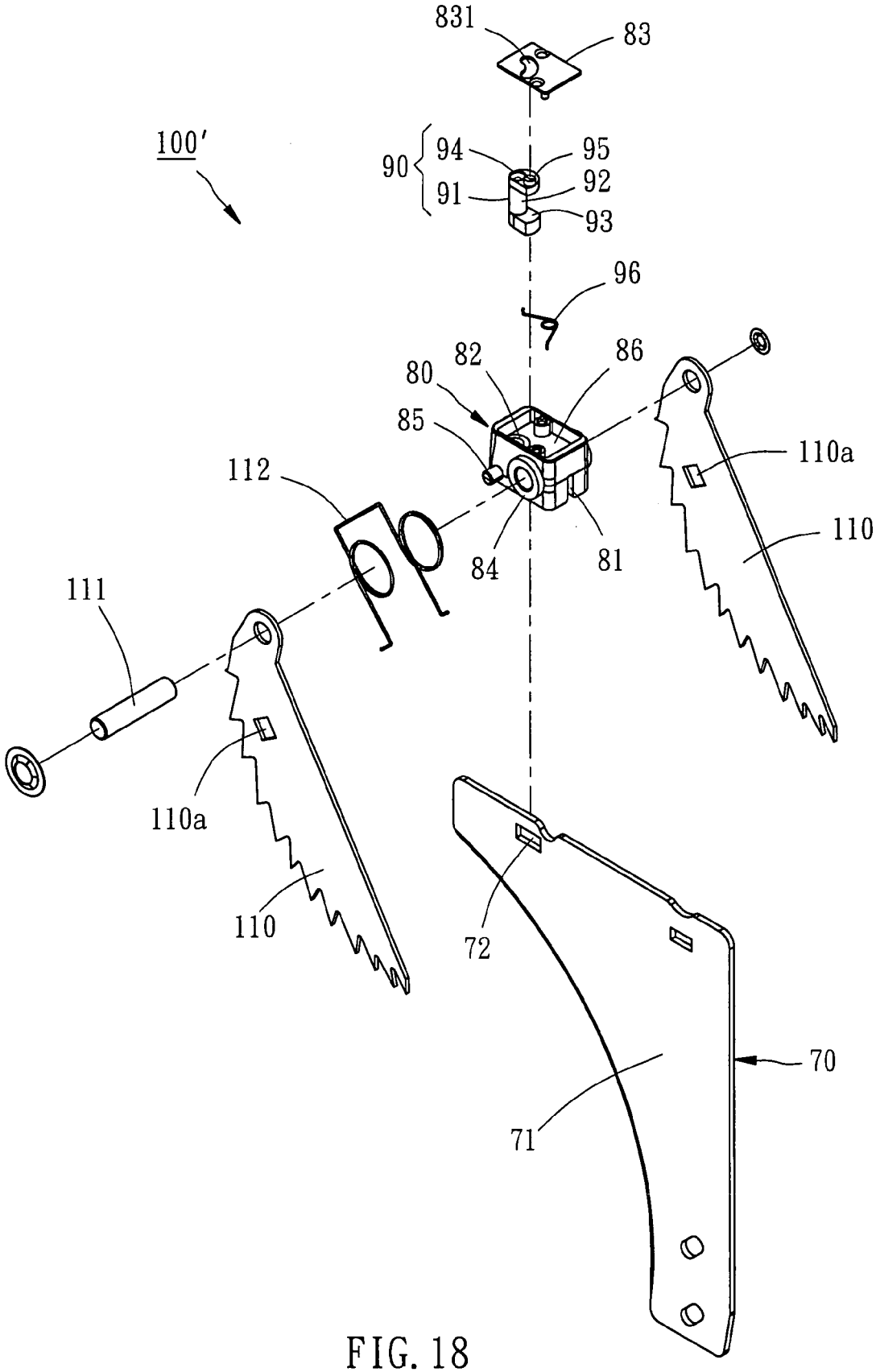
FIG. 18 is a perspective view of a second embodiment of the present invention.
Figure 20:
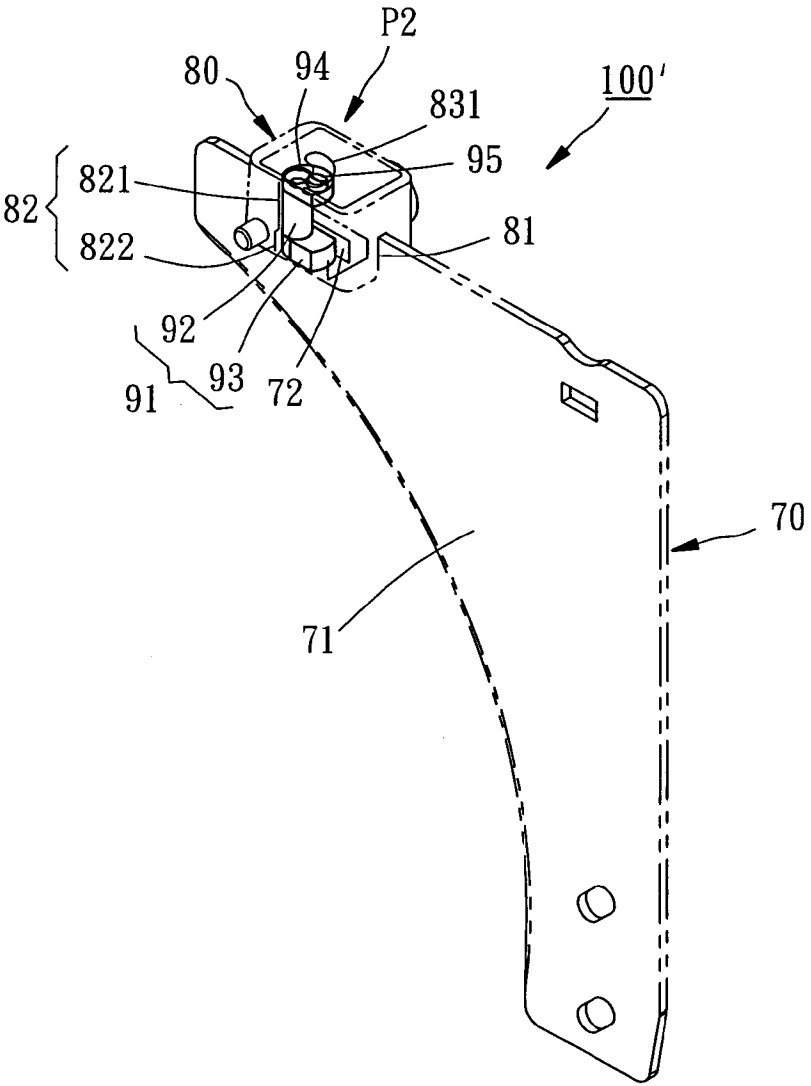
FIG. 20 is similar to FIG. 19 but showing that the lug is turned to the second position and the coupling block is released from the mounting member.
Figure 19:
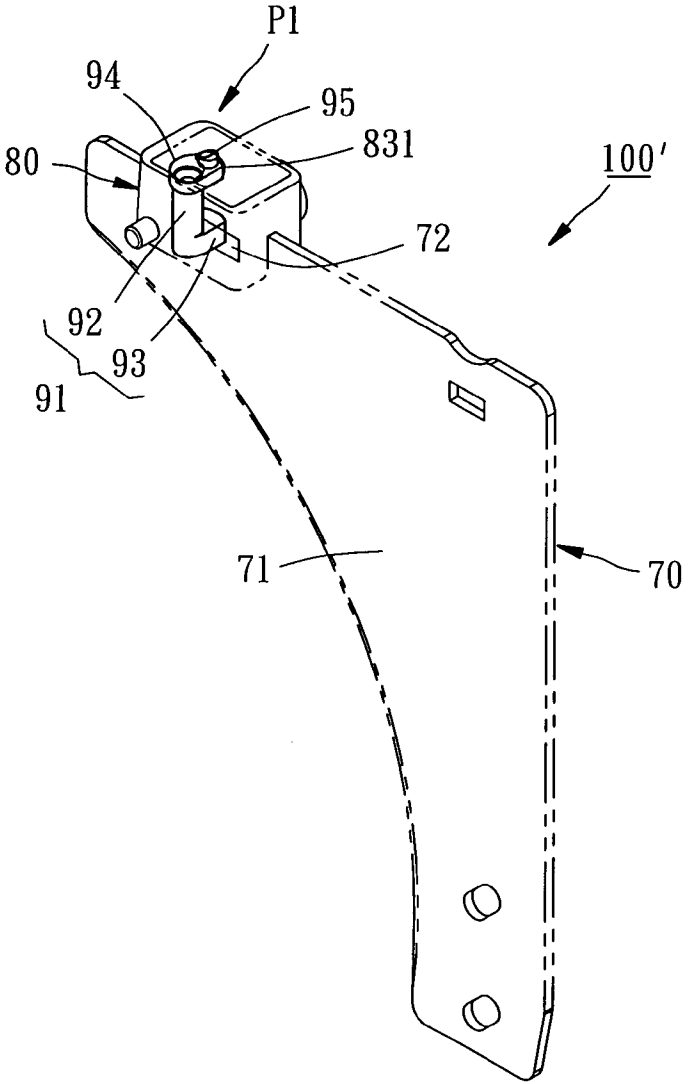
FIG. 19 is a schematic perspective assembly view of the second embodiment of the present invention, showing that the lug is held in the first position and the coupling block is locked to the mounting member.

FIGS. 18-20 show a saw blade guard assembly 100' in accordance with a second embodiment of the present invention. According to this embodiment, the saw blade guard assembly 100' comprises a mounting member 70, a coupling block 80, a rotary locking member 90, a return member 96, two detents 110, and a biasing member 112. The mounting member 70, the coupling block 80, the rotary locking member 90 and the return member 96 constitute a quick release structure.

The mounting member 70 has a body 71 and a retaining hole 72 on the body 71 near its top side.

The coupling block 80 has a bottom clamping groove 81 for securing the body 71 of the mounting member 70, a stepped through hole 82, which has an upper section 821 of relatively smaller diameter and a lower section 822 of relatively greater diameter for accommodating the rotary locking member 90, a top cover plate 83, which constitutes the top surface of the coupling block 80 and has an arched slot 831, an axle sleeve 84 fixedly provided near the rear side and working as a mounting portion of the coupling block 80, two protruding rods 85 respectively extended from two opposite lateral sides near the front, and a countersunk groove 86.

The rotary locking member 90 includes a retaining rod 91 and a lug 94. The lug 94 is fixedly connected to the top end of the retaining rod 91, forming the pushable portion of the rotary locking member. The retaining rod 91 has a rod body 92 and a protrusion head 93. The rod body 92 has a diameter approximately equal to the upper section 821 of the through hole 82, and is inserted through the upper section 821 of the through hole 82. The protrusion head 93 is radially extended from the bottom end of the retaining rod 91 and suspending in the lower section 822 of the through hole 82. The protrusion head 93 works as a retaining portion of the rotary locking member 90. The lug 94 has a top rod 95 extending out of the arched slot 831 of the cover plate 83 for operation by the user to turn the lug 94 and the retaining rod 91 in the through hole 82. The two ends of the arched slot 831 form a first stop portion and a second stop portion of the coupling block 80 respectively. Thus, the user can move the top rod 95 along the arched slot 831 between a first position P1 where the rod 95 is stopped at one end of the arched slot 831 (see FIG. 19) and a second position P2 where the rod 95 is stopped at the other end of the arched slot 831 (see FIG. 20). Further, a return member 96 is mounted in the countersunk groove 86 of the coupling block 80 and adapted to impart a return force to the lug 94, biasing the lug 94 toward the first position P1.

The detents 110 are respectively pivotally connected to the two opposite ends of the axle sleeve 84 of the coupling block 80 by a pin 111. The biasing member 112 is mounted on the axle sleeve 84, having two opposite ends respectively hooked in a respective hook hole 110*a* on each of the detents 110. Thus, the biasing member 112 imparts a biasing force the detents 110 against the protruding rods 85 respectively.

When the rod 95 receives no external force, the rod 95 is stopped at one end of the arched slot 831 in the first position P1. At this time, the rod body 92 of the retaining rod 91 is disposed at one side of the body 71 of the mounting member 70, and the protrusion head 93 of the rotary locking member 90 is engaged into the retaining hole 72 (see FIG. 19) to lock the coupling block 80 to the mounting member 70. When moving the rod 95 along the arched slot 831 from the first position P1 to the second position P2 against the return force of the return member 96 (see FIG. 20), the retaining rod 91 is rotated to disengage the protrusion head 93 from the retaining hole 72, allowing removal of the coupling block 80 from the mounting member 70. On the contrary, when wanting to install the coupling block 80 in the mounting member 70, operate the rod 95 to hold the lug 94 in the second position P2, and then attach the clamping groove 81 of the coupling block 80 to the topmost edge of the body 71 of the mounting member 70, and then release the rod 95 for enabling the return member 96 to return the lug 94 to the first position P1 to force the protrusion head 93 into engagement with the retaining hole 72, and therefore the coupling block 80 is locked to the mounting member 70.

As indicated, the quick release structure of the present invention allows quick mounting and dismounting of two detachable members (for example, the guard and the mounting member) without using tools, thereby saving much mounting and dismounting time.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A quick release structure comprising:

a mounting member having a body with a retaining hole;

a coupling block having a clamping groove for fastening to the body of said mounting member and a through hole in communication with said clamping groove; and a rotary locking member having a rod body pivotally inserted in the through hole of said coupling block and provided with a retaining portion at an end thereof engaging said retaining hole of said mounting member, and a pushable portion at the other end thereof rotatable by an external force to move said retaining portion to be disengaged from said retaining hole of said mounting member;

wherein the retaining hole of said mounting member is formed on the body of said mounting member near a top side of said body;

the through hole of said coupling block is a stepped through hole having an upper section and a lower section, said lower section having a diameter greater than said upper section;

the retaining portion of said rotary locking member is a protrusion head and the pushable portion of said rotary locking member is a lug rotatable between a first position where the protrusion head of the rotary locking member is pivotally engaged into the retaining hole of said mounting member and a second position where the protrusion head of the rotary locking member is pivotally disengaged from the retaining hole of said mounting member.

2. The quick release structure as claimed in claim 1, wherein said coupling block has a first stop portion for stopping the lug of the rotary locking member in said first position, and a second stop portion for stopping the lug of the rotary locking member in said second position.

3. The quick release structure as claimed in claim 2, wherein said coupling block has a countersunk groove on a top surface thereof in communication with the through hole of the coupling block, and a return member mounted in said countersunk groove for imparting a return force to the lug of the rotary locking member to hold the lug of the rotary locking member at said first stop portion in said first position.

4. The quick release structure as claimed in claim 3, wherein said mounting member has a top notch in communication with said retaining hole, and a hook portion suspending between said top notch and said retaining hole; the rod body of said rotary locking member is inserted through the top notch of said mounting member to hold the protrusion head in the retaining hole such that the protrusion head is engaged with the hook portion when the lug of the rotary locking member is in said first position; the protrusion head is disengaged from the hook portion when the lug of the rotary locking member is in said second position.

5. The quick release structure as claimed in claim 4, wherein said coupling block has a first stop block and a second stop block respectively protruding from a top surface thereof and forming the first stop portion and the second stop portion of the coupling block; the lug of said rotary locking member has a rod that is stopped against the first stop block when the lug is in said first position and stopped against the second stop block when the lug is in said second position.

6. A saw blade guard assembly of a table saw comprising:

a mounting member having a body with a retaining hole;

a coupling block having a clamping groove for fastening to the body of said mounting member, a through hole in communication with said clamping groove, and a mounting portion;

a rotary locking member having a rod body pivotally inserted in the through hole of said coupling block and provided with a retaining portion at an end thereof engaging said retaining hole of said mounting member, and a pushable portion at the other end thereof rotatable by an external force to move said retaining portion to be disengaged from said retaining hole of said mounting member; and an attachment member detachably connected to the mounting portion of said coupling block;

wherein the retaining hole of said mounting member is formed on the body of said mounting member near a top side of said body;

the through hole of said coupling block is a stepped through hole having an upper section and a lower section, said lower section having a diameter greater than said upper section;

the retaining portion of said rotary locking member is a protrusion head and the pushable portion of said rotary locking member is a lug rotatable between a first position where the protrusion head of the rotary locking member is pivotally engaged into the retaining hole of said mounting member and a second position where the protrusion head of the rotary locking member is pivotally disengaged from the retaining hole of said mounting member.

7. The saw blade guard assembly as claimed in claim 6, wherein said coupling block has a countersunk groove on a top surface thereof in communication with the through hole of the coupling block, and a return member mounted in said countersunk groove for imparting a return force to the lug of the rotary locking member to hold the lug of the rotary locking member in said first position.

8. The saw blade guard assembly as claimed in claim 7, wherein said mounting member has a top notch in communication with said retaining hole, and a hook portion suspending between said top notch and said retaining hole; the rod body of said rotary locking member is inserted through the top notch of said mounting member to hold the protrusion head in the retaining hole such that the protrusion head is engaged with the hook portion when the lug of the rotary locking member is in said first position; the protrusion head is disengaged from the hook portion when the lug of the rotary locking member is in said second position.

9. The saw blade guard assembly as claimed in claim 8, wherein said coupling block has a first stop block and a second stop block respectively protruding from a top surface thereof; the lug of said rotary locking member has a rod that is stoppable with the first stop block or the second stop block.

10. The saw blade guard assembly as claimed in claim 6, wherein the mounting portion of said coupling block is an axle sleeve; said attachment member is a guard pivoted to the axle sleeve.

11. The saw blade guard assembly as claimed in claim 6, wherein the mounting portion of said coupling block is an axle sleeve; said attachment member includes two detents respectively pivoted to the axle sleeve at two sides.

12. The saw blade guard assembly as claimed in claim 11, wherein the coupling block has two protruding rods respectively extending from two opposite lateral sides thereof; the axle sleeve of the coupling block supports a biasing member that imparts a biasing force to said two detents to force said two detents against said protruding rods.

* * * * *